US006241015B1

(12) United States Patent
Pringle et al.

(10) Patent No.: US 6,241,015 B1
(45) Date of Patent: Jun. 5, 2001

(54) APPARATUS FOR REMOTE CONTROL OF WELLBORE FLUID FLOW

(75) Inventors: Ronald E. Pringle, Houston; Clay W. Milligan, Jr., Missouri City; Dwayne D. Leismer, Pearland, all of TX (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/295,045

(22) Filed: Apr. 20, 1999

(51) Int. Cl.[7] ..... E21B 34/10; E21B 34/12

(52) U.S. Cl. ..... 166/66.4; 137/624.18; 137/627; 166/66.7; 166/240; 166/320; 166/332.2

(58) Field of Search ..... 166/66.4, 66.6, 166/66.7, 240, 319, 320, 331, 332.2, 375; 137/624.18, 627, 869, 870

(56) References Cited

U.S. PATENT DOCUMENTS

| | | | | |
|---|---|---|---|---|
| 3,494,419 | * | 2/1970 | Mullins | 166/331 X |
| 3,665,955 | * | 5/1972 | Conner, Sr. | 166/66.4 X |
| 3,990,511 | | 11/1976 | Gazda . | |
| 4,113,012 | * | 9/1978 | Evans et al. | 166/321 X |
| 4,771,831 | * | 9/1988 | Pringle et al. | 166/319 |
| 4,951,753 | * | 8/1990 | Eriksen | 166/375 |
| 5,070,944 | * | 12/1991 | Hopper | 166/66.7 |
| 5,172,717 | | 12/1992 | Boyle et al. . | |
| 5,447,201 | | 9/1995 | Mohn . | |
| 5,483,987 | * | 1/1996 | Du Chaffaut et al. | 166/240 X |
| 5,996,687 | * | 12/1999 | Pringle et al. | 166/66.6 |

FOREIGN PATENT DOCUMENTS

| | | |
|---|---|---|
| WO 97/37102 | 10/1997 | (WO) . |
| WO 99/05395 | 2/1999 | (WO) . |

* cited by examiner

*Primary Examiner*—George Suchfield
(74) *Attorney, Agent, or Firm*—Goldstein & Healey

(57) ABSTRACT

An apparatus for remotely controlling fluids in a well is provided. The flow control apparatus may include a body member having a flow port in an outer wall of the body member, and a flow aperture spaced inwardly from the outer wall. A remotely shiftable valve member may be disposed for reciprocal movement within the body member to regulate fluid flow through the flow aperture and flow port. An indexing sleeve may be rotatably disposed within the body member and engaged with the shiftable valve member to shift the valve member within the body member. An operating piston may be engaged with the indexing sleeve and movably disposed within the body member in response to pressurized fluid. A locking mechanism may also be included for locking the shiftable valve member in a closed, or sealing, position. Electrically-operated mechanisms for shifting the valve member is also provided.

31 Claims, 6 Drawing Sheets

APPARATUS FOR REMOTE CONTROL OF WELLBORE FLUID FLOW

BACKGROUND OF THE INVENTION

1. Field of Invention

The present invention relates to subsurface well completion equipment and, more particularly, to an apparatus and related methods for remotely controlling fluid recovery from a wellbore and/or any lateral wellbores extending therefrom.

2. Related Art

The economic climate of the petroleum industry demands that oil companies continually improve their recovery systems to produce oil and gas more efficiently and economically from sources that are continually more difficult to exploit and without increasing the cost to the consumer. One successful technique currently employed is the drilling of horizontal, deviated, and multilateral wells, in which a number of deviated wells are drilled from a main borehole. In such wells, and in standard vertical wells, the well may pass through various hydrocarbon bearing zones or may extend through a single zone for a long distance. One manner to increase the production of the well, therefore, is to perforate the well in a number of different locations, either in the same hydrocarbon bearing zone or in different hydrocarbon bearing zones, and thereby increase the flow of hydrocarbons into the well.

One problem associated with producing from a well in this manner relates to the control of the flow of fluids from the well and to the management of the reservoir. For example, in a well producing from a number of separate zones, or laterals in a multilateral well, in which one zone has a higher pressure than another zone, the higher pressure zone may produce into the lower pressure zone rather than to the surface. Similarly, in a horizontal well that extends through a single zone, perforations near the "heal" of the well—nearer the surface—may begin to produce water before those perforations near the "toe" of the well. The production of water near the heal reduces the overall production from the well. Likewise, gas coning may reduce the overall production from the well.

A manner of alleviating this problem is to insert a production tubing into the well, isolate each of the perforations or laterals with packers, and control the flow of fluids into or through the tubing. However, typical flow control systems provide for either on or off flow control with no provision for throttling of the flow. To fully control the reservoir and flow as needed to alleviate the above described problem, the flow must be throttled. A number of devices have been developed or suggested to provide this throttling although each has certain drawbacks. Note that throttling may also be desired in wells having a single perforated production zone.

Specifically, the prior devices are typically either wireline retrievable valves, such as those that are set within the side pocket of a mandrel, or tubing retrievable valves that are affixed to the tubing string. An example of a wireline retrievable valve is shown in U.S. patent application Ser. No. 08/912,150 by Ronald E. Pringle entitled Variable Orifice Gas Lift Valve for High Flow Rates with Detachable Power Source and Method of Using Same that was filed Aug. 15, 1997 and which is hereby incorporated herein by reference. The variable orifice valve shown in that application is selectively positionable in the offset bore of a side pocket mandrel and provides for variable flow control of fluids into the tubing. The wireline retrievable valve has the advantage of retrieval and repair while providing effective flow control into the tubing without restricting the production bore.

However, one drawback associated with the current wireline retrievable-type valves is that the valves have somewhat limited flow area an important consideration in developing a flow control systems.

A typical tubing retrievable valve is the standard "sliding sleeve" valve, although other types of valves such as ball valves, flapper valves, and the like may also be used. In a sliding sleeve valve, a sleeve having orifices radially therethrough is positioned in the tubing. The sleeve is movable between an open position, in which the sleeve orifices are aligned with orifices extending through the wall of the tubing to allow flow into the tubing, and a closed position, in which the orifices are not aligned and fluid cannot flow into the tubing. Elastomeric seals extending the full circumference of the sleeve and located at the top of the sleeve and the bottom of the sleeve provide the desired sealing between the sleeve and the tubing. Due to the presence of the elastomeric seals, reliability may be an issue if the sleeve valve is left downhole for a long period of time because of exposure to caustic fluids.

Remote actuators for the sleeve valves have recently been developed to overcome certain other difficulties often encountered with operating the valves in horizontal wells, highly deviated wells, and subsea wells using slickline or coil tubing to actuate the valve. The remote actuators are positioned in the well proximal the valve to control the throttle position of the sleeve.

However, after a sleeve valve has been exposed to a wellbore environment for some time, the sleeve may be stuck or rendered more difficult to operate due to corrosion and debris. Additionally, the hydraulic seals of the sleeve add substantial drag to movement of the sleeve valve, rendering its operation even more difficult. Sleeve valves may require relatively large forces to overcome the drag from hydraulic seals in the valve, particularly when the sleeve valve is exposed to high pressure and corrosion. In addition, a sleeve valve may require a relatively long stroke to move between a fully open position and a fully closed position. As a result of the relatively large forces and long strokes employed to actuate a sleeve valve, an actuator employed to open and close the valve may need to be relatively high powered. Providing such high power may require a large actuator, sophisticated electronic circuitry, and relatively large diameter electrical cables, run from the surface to the valve actuator mechanism.

An additional problem associated with the use of hydraulic actuators is the limitations in the number of possible choke positions. Some prior systems, such as that shown in the U.S. patent application Ser. No. 09/037,309 by Ronald E. Pringle entitled Variable Orifice Gas Lift Valve for High Flow Rates with Detachable Power Source and Method of Using Same that was filed Mar. 3, 1998 and which is incorporated herein by reference, utilize a shifting system employing slots to selectively move the valve to a variety of predetermined choke positions between open and closed. Because the shifting system required for a hydraulic actuator limits the number of possible positions within which the choke may be placed, the ability to control the flow and pressure is limited. Thus, a system providing finer control of the flow through the choke is desired.

Consequently, despite the features of the prior art, there remains a need for a flow control system that provides a relatively high flow rate, that reduces the power requirements for operation over previous designs, that is adaptable to the requirements of the particular well, that provides for finer control of the choke when using a hydraulic actuator, and that provides an efficient, reliable, erosion-resistant system that can withstand the caustic environment of a well bore.

SUMMARY

To achieve such improvements, the present invention provides an apparatus for remote control of wellbore fluid that includes at least one aperture extending through the wall of a tubing, a shiftable valve member positioned and adapted to selectively open, close, and choke the valve member, and an actuator attached to and adapted to selectively shift valve member. By providing a plurality of valve members and providing variations to the shift mechanism, the flow into (or from) the tubing may be controlled and the shifting mechanism can be designed to provide a high number of shifting positions.

One aspect of the present invention provides an apparatus for remote control of wellbore fluid flow that includes a body member having at least one flow port in an outer wall of the body member and at least one flow aperture spaced from the outer wall. At least one remotely shiftable valve member is offset from an inner bore in the body member and disposed for reciprocal movement within the body member to regulate fluid flow through at least one flow aperture and through at least one flow port. An actuator is adapted to selectively shift at least one remotely shiftable valve member between the open and closed positions.

In one preferred embodiment, the actuator includes an indexing sleeve rotatably disposed within the body member and engaged with the shiftable valve member to shift the shiftable valve member within the body member. The indexing sleeve is disposed for rotatable movement about an inner wall within the body member and secured to the inner wall to restrict longitudinal movement therebetween. The first end of the indexing sleeve includes a flange movably engaged with a recess in the second end of the shiftable valve member, the flange includes at least one protuberance engageable with the recess. Further, the indexing sleeve is rotatable into a plurality of discrete positions to remotely control the degree to which the shiftable valve member is opened and closed.

In a preferred embodiment, the actuator includes an operating piston engaged with the indexing sleeve and movably disposed within the body member in response to pressurized fluid. The indexing sleeve includes an indexing profile having an alternating series of ramped slots disposed in a zig-zag pattern about the indexing sleeve. The operating piston includes an arm having a finger disposed at a distal end thereof and engaged with the indexing profile. Each ramped slot includes a first end and a second end and inclines upwardly from its first end to its second end. The first and second ends of neighboring slots are adjacent to one another and an intersection of each of the adjacent first and second ends are defined by a retaining shoulder. In a selected embodiment, the operating piston is sealably disposed for movement within an operating piston cylinder in the body member between the inner and outer walls. Preferably, a first side of the operating piston is in fluid communication with a source of pressurized fluid and a second side of the operating piston is biased in opposition to the source of pressurized fluid by at least one of a spring, a contained source of pressurized gas within the body, and a remote source of pressure. A lockdown sleeve is engaged with the indexing sleeve and at least one lockdown piston. A first end of the lockdown sleeve has a locking protuberance releasably engageable with a locking recess in the body member. A first end of the lockdown piston is connected to an annular locking member. The lockdown piston causes the annular locking member to force the shiftable valve member into a locked position when the locking protuberance is engaged with the locking recess. The lockdown piston includes an arm having a finger disposed at a second end of the lockdown piston, is engaged with an annular groove in the lockdown sleeve. The arm is in fluid communication with a source of pressurized fluid, has a diameter less than a diameter of the operating piston, and is sealably disposed for movement within a lockdown piston cylinder in the body member.

In an alternative preferred embodiment, the actuator includes an electrical conduit connected to an electric motor. The electric motor is secured to the body member and mechanically engaged with the indexing sleeve. The electric motor includes a shaft having a pinion gear connected thereto. The pinion gear is adapted for engagement with a plurality of teeth disposed about the indexing sleeve.

In another preferred embodiment, the actuator includes an electrical conduit connected to an electric motor. The electric motor is secured to the body member and mechanically engaged with the remotely shiftable valve member. The electric motor includes a shaft having a pinion gear connected thereto. The pinion gear is adapted for engagement with a ball and screw assembly. The ball is rotatably engaged with the pinion gear and the screw is connected to the shiftable valve member and threadably disposed within the ball.

In another selected embodiment, the body member includes a first end, a second end, and an inner wall disposed within the body member, spaced from the outer wall, extending from the second end of the body member, and has a distal end terminating within the body member. The flow aperture and the shiftable valve member is disposed between the inner and outer walls.

Another preferred embodiment includes a spring biasing the shiftable valve member toward the flow aperture. The remotely shiftable valve member is preferably sealably disposed for movement within a valve cylinder in the body member.

Another preferred embodiment includes at least one secondary shiftable valve member for controlling fluid flow through a corresponding secondary flow aperture in the body member. The diameters of the secondary shiftable valve member and the secondary flow aperture are less than the respective diameters of the shiftable valve member and the flow aperture.

Another aspect of the present invention provides an apparatus for remote control of wellbore fluid flow that includes several parts. One part of the apparatus is a body member that has a first end, a second end, an outer wall, an inner wall, at least one flow port in the outer wall, and at least one flow aperture that is between the inner and outer walls. The inner wall is spaced from the outer wall, extends from the second end of the body member, and has a distal end terminating within the body member. The apparatus also includes at least one remotely shiftable valve member that is for reciprocal movement within the body member between the inner and outer walls. This valve regulates fluid flow through the flow aperture and through the flow port. Another part of the apparatus includes an indexing sleeve that rotates about the inner wall and is secured to the inner wall to restrict longitudinal movement therebetween. The indexing sleeve is engaged with the shiftable valve member to shift the shiftable valve member within the body member. And finally the apparatus has an operating piston engaged with the indexing sleeve, sealably disposed for movement within an operating piston cylinder in the body member between the inner and outer walls. A first side of the operating piston is in fluid communication with a source of pressurized fluid. A second side of the operating piston is biased in opposition to the source of pressurized fluid by at least one of a spring, a contained source of pressurized gas within the body member, and a remote source of pressure.

In one preferred embodiment, a first end of the indexing sleeve includes a flange movably to engaged with a recess in a second end of the shiftable valve member. The flange includes at least one protuberance engageable with the recess. The indexing sleeve includes an indexing profile having an alternating series of ramped slots disposed in a zig-zag pattern about the indexing sleeve. The operating piston includes an arm having a finger disposed at a distal end that is engaged with the indexing profile. Each ramped slot includes a first end and a second end and inclines upwardly from its first end to its second end. The first and second ends of neighboring slots are disposed adjacent to one another and an intersection of each of the adjacent first and second ends are defined by a retaining shoulder. A lockdown sleeve is engaged with the indexing sleeve and with at least one lockdown piston. A first end of the lockdown sleeve has a locking protuberance releasably engageable with a locking recess in the body member. A first end of the lockdown piston is connected to an annular locking member. The lockdown piston causes the annular locking member to force the shiftable valve member into a locked position when the locking protuberance is engaged with the locking recess. To remotely control the degree to which the shiftable valve member is opened and closed, the indexing sleeve is rotatable into a plurality of discrete positions.

Another aspect of the present invention provides an apparatus for remote control of wellbore fluid flow that comprises a body member that has at least one flow port in an outer wall of the body member and at least one flow aperture spaced from the outer wall. The apparatus also includes shiftable valve means for regulating fluid flow through the flow aperture and actuating means for selectively shifting the valve means between open and closed positions.

In a preferred embodiment the actuating means includes rotatable indexing means engaged with the valve means for shifting the valve means, a piston means engaged with the indexing means for shifting the indexing means into a plurality of discrete positions, and means for remotely controlling movement of the piston means. In one alternative embodiment, the actuating means includes electrically-operated means connected to the body member and engaged with the valve means.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

For the purposes of this discussion, the terms upper and lower, up hole and downhole, and upwardly and downwardly are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Figure 1A:
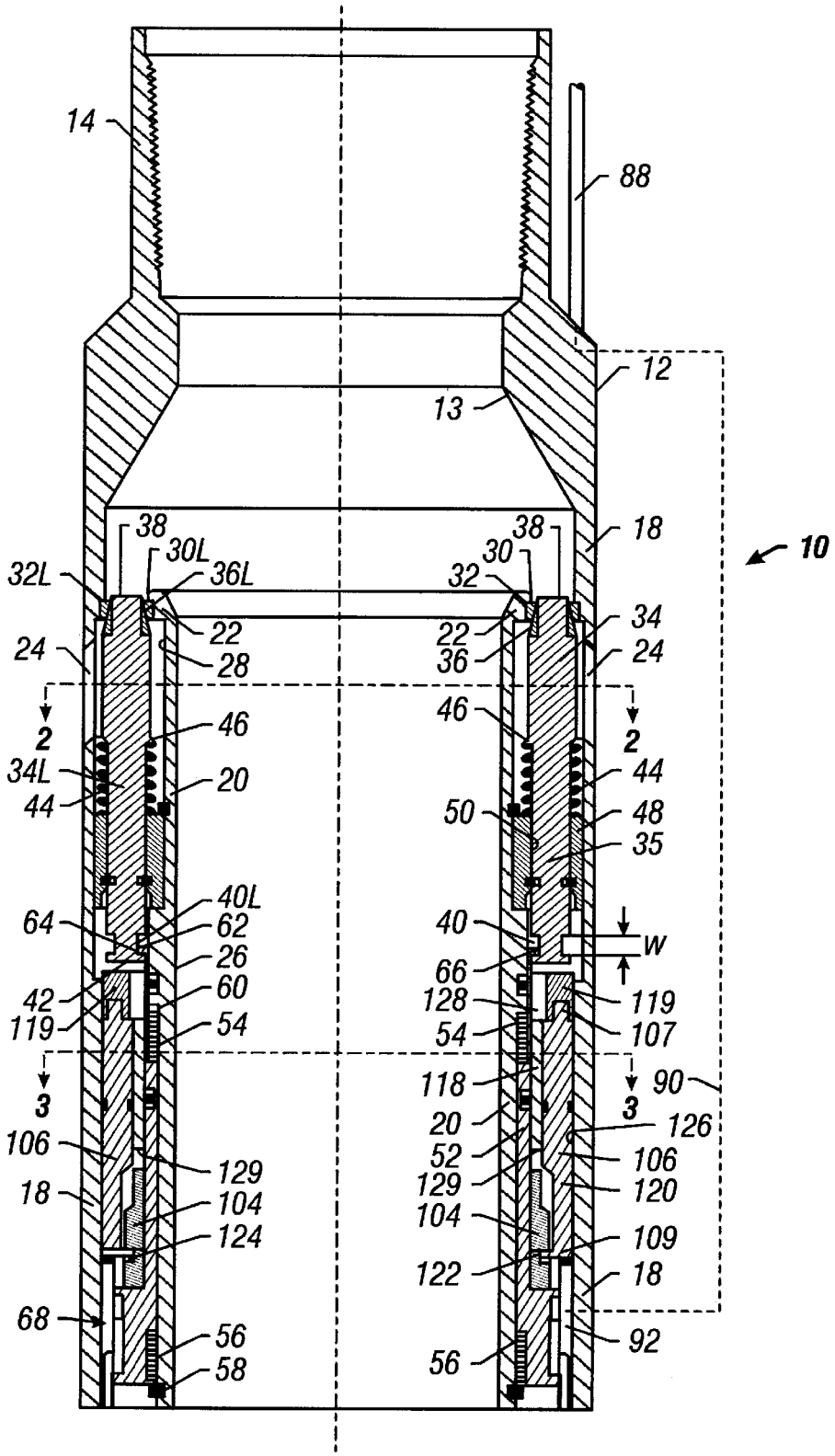
FIG. 1A–1B illustrate a longitudinal cross-sectional view of a specific embodiment of the apparatus of the present invention.
Figure 1B:
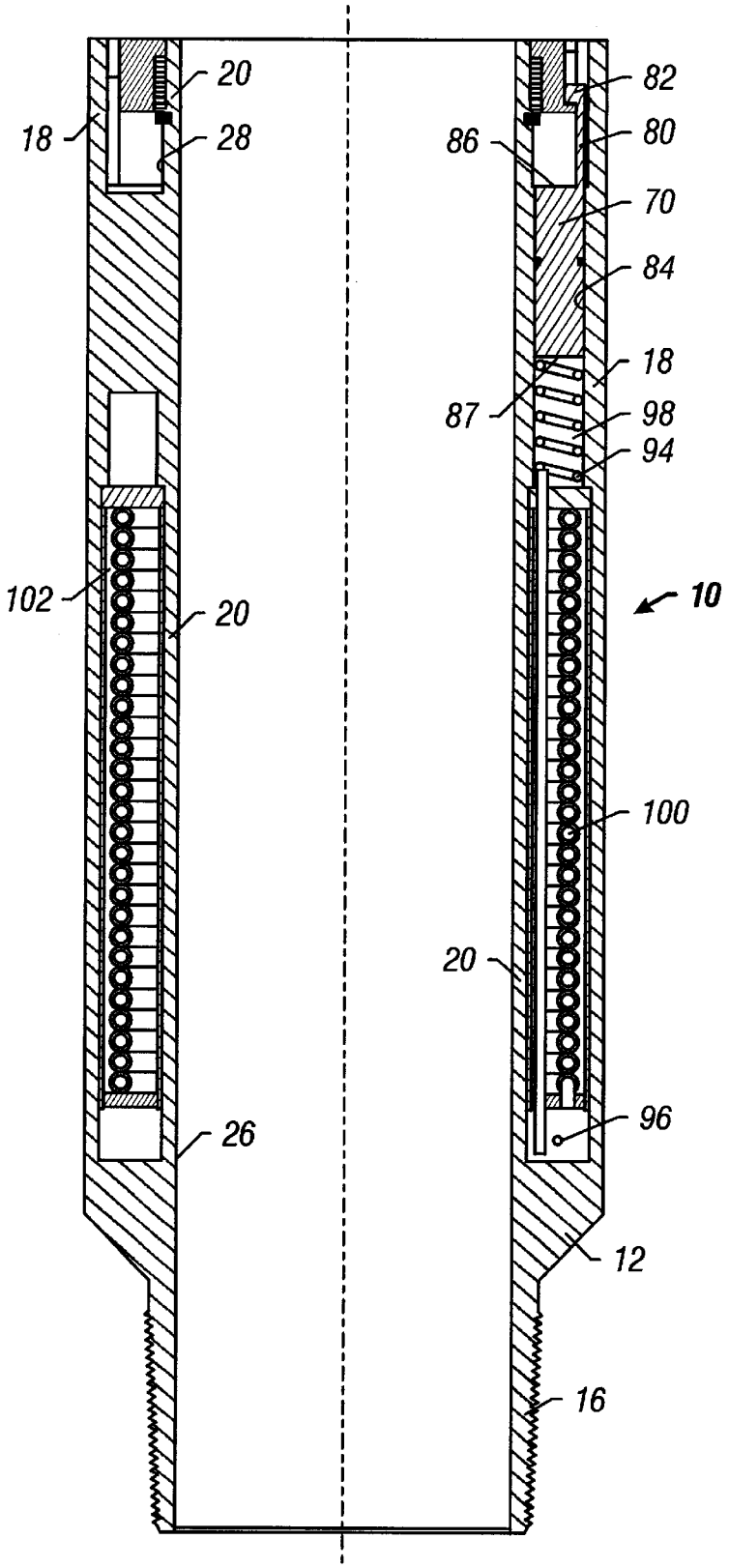
Figure 2:
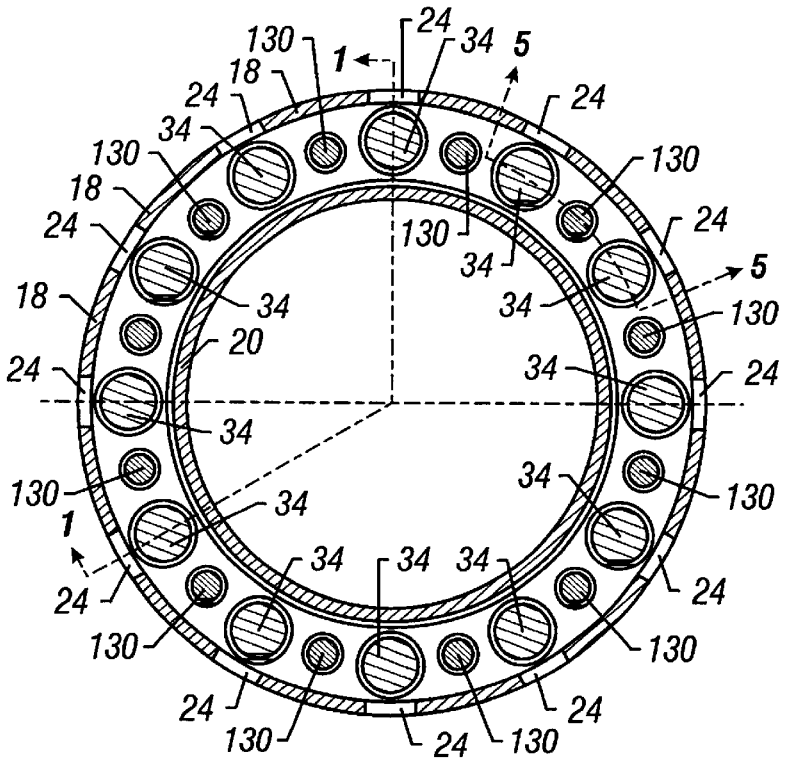
FIG. 2 is a cross-sectional view taken along line 2—2 of FIG. 1A.
Figure 3:
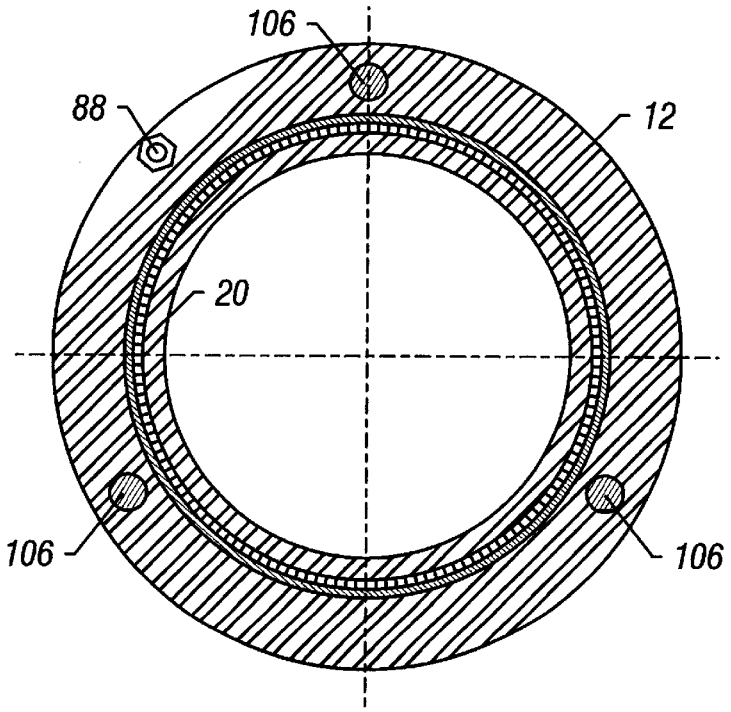
FIG. 3 is a cross-sectional view taken along line 3—3 of FIG. 1A.

Referring now to the drawings in detail, wherein like numerals denote identical elements throughout the several views, it can be seen with reference to FIGS. 1A–1B that the flow control apparatus of the present invention is generally referred to by the numeral 10. The flow control apparatus 10 includes a body member 12 having a first end 14 (FIG. 1A), a second end 16 (FIG. 1B), an outer wall 18, and an inner wall 20 disposed within the body member 12 and spaced from the outer wall 18. The inner wall 20 extends from the second end 16 of the body member 12 and has a distal end 22 (FIG. 1A) terminating within the body member 12. In a specific embodiment, the distal end 22 may terminate between at least one flow port 24 in the outer wall 18 of the body member 12 and the first end 14 of the body member 12. The inner wall 20 includes an inner bore 26 and an outer surface 28. The inner bore 26 extends from the distal end 22 to the second end 16 of the body member 12.

With reference to FIG. 1A, the body member 12 further includes at least one flow aperture 30. In a specific embodiment, the at least one flow aperture 30 may be disposed in the body member 12 between the outer wall 18 and the inner wall 20, and between the at least one flow port 24 and the first end 14 of the body member 12. In a specific embodiment, the at least one flow aperture 30 may be disposed proximate the distal end 22 of the inner wall 20. In a specific embodiment, the at least one flow aperture 30 may further include a first annular sealing surface 32. Still referring to FIG. 1A, the flow control apparatus 10 further includes at least one remotely shiftable valve member 34 offset from the inner bore 26 in the body member 12 and disposed for reciprocal movement within the body member 12 to alternately permit and prevent fluid flow through the at least one flow aperture 30. The present invention is not limited to any particular number of valve members 34 although a preferred embodiment includes a plurality of valve members to provide a relatively high potential flow rate. Each valve member 34 may include a second annular sealing surface 36 adjacent a first end 38 of the valve member 34 for cooperative sealing engagement with the first annular sealing surface 32 disposed about the at least one flow aperture 30. The valve member 34 is further provided with a recess 40 adjacent a second end 42 of the valve member 34, the purpose of which will be explained below. The valve member 34 may be biased toward the at least one flow aperture 30, and into a sealing position to prohibit fluid flow through the at least one flow aperture 30, by a spring 44 disposed about the valve member 34, and between an annular shoulder 46 on the valve member 34 and a tubular insert 48 disposed between the outer wall 20 and the inner wall 18. The tubular insert 48 may be affixed to, or part of, the body member 12, and may include a valve cylinder 50 within which a cylindrical portion 35 of the valve member 34 may be sealably disposed for axial movement.

Figure 4:
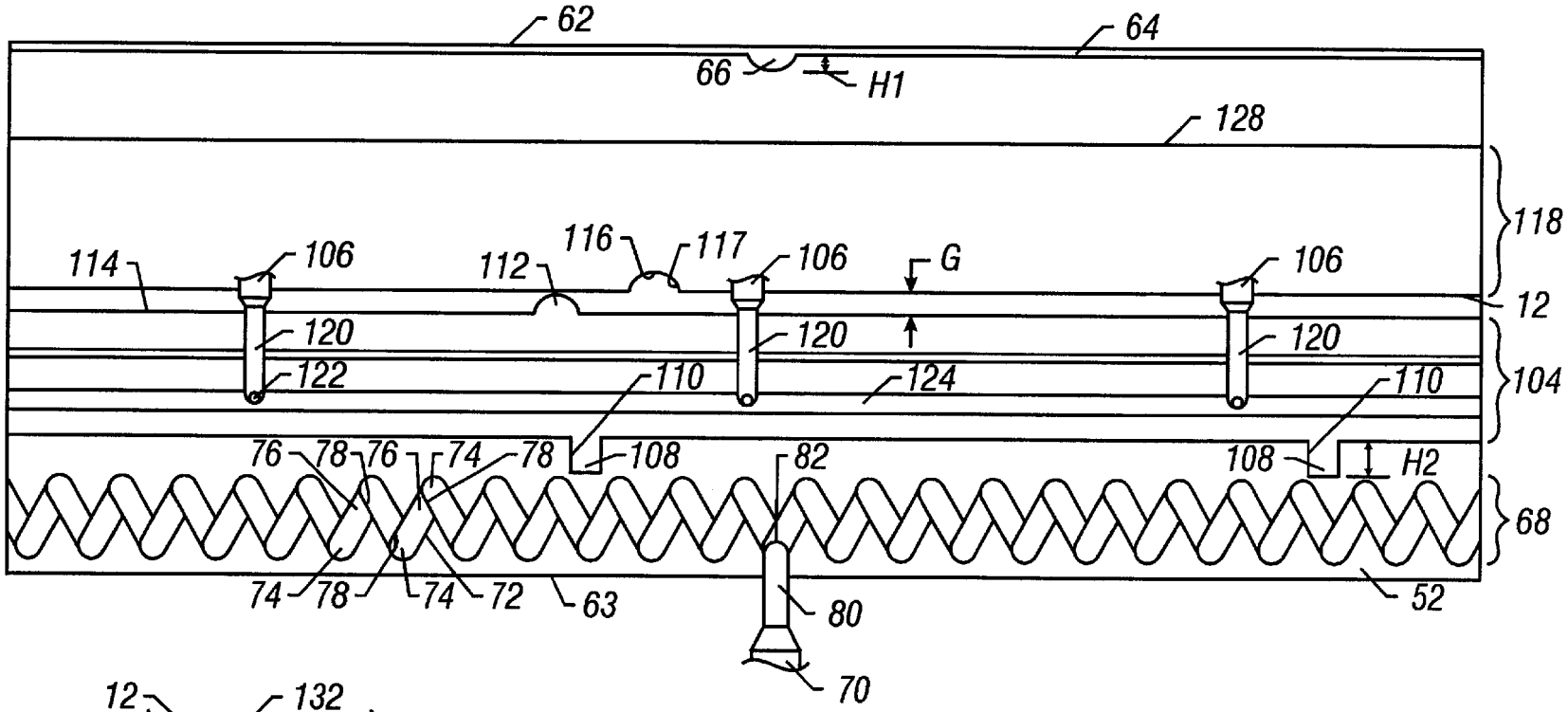
FIG. 4 is a planar projection illustrating the circumference of a rotatable indexing cylinder of the present invention.

The flow control apparatus 10 may further include an actuator adapted to selectively shift the at least one remotely shiftable valve member between open and closed positions. In a specific embodiment, as shown in FIGS. 1A and 4, the actuator may include an indexing sleeve 52 rotatably disposed within the body member 12 and engaged with the at least one shiftable valve member 34 to shift the at least one shiftable valve member 34 within the body member 12. In a specific embodiment, the indexing sleeve 52 may be rotatably disposed, as per bearings 54 and 56, about the outer surface 28 of the inner wall 20. While the indexing sleeve 52 is rotatable relative to the body member 12, the valve 10 is adapted to restrict longitudinal movement between the indexing sleeve 52 and the body member 12, as per a retaining ring 58 and an annular retaining shoulder 60, both of which may be disposed about the outer surface 28 of the inner wall 20. A first end 62 of the indexing sleeve 52 includes a flange 64 movably engaged with the recess 40 in the second end 42 of the shiftable valve member 34. As best shown in FIG. 4, the flange 64 includes at least one cam-like protuberance 66 extending away from the first end 62 of the indexing sleeve 52. In a specific embodiment, the protuberance 66 may have a semi-circular profile. As the indexing sleeve 52 rotates about the outer surface 28 of the inner wall 20, the flange 64 will move relative to the recess 40 in the at least one shiftable valve member 34. When only the flange 64 is engaged with the recess 40L, as shown with regard to the valve member 34L on the left side of FIG. 1A (hence the L designator), the second annular sealing surface 36L of the shiftable valve member 34L will be sealably engaged with the first annular sealing surface 32L so as to prohibit fluid flow through the at least one flow aperture 30L. But when the flange protuberance 66 moves into engagement with the recess 40, as shown with regard to the valve member 34 on the right side of FIG. 1A, the valve member 34 will be shifted, or pulled, away from the at least one flow aperture 30, thereby separating the first and second annular sealing surfaces 32 and 36 and permitting fluid flow through the at least one flow aperture 30. This will also establish fluid communication between a first bore 13 of the body member 12 and the at least one flow port 24 in the outer wall 18 of the body member 12.

The indexing sleeve 52 is shown with only one protuberance 66 for clarity only. This should not be taken as a limitation. Instead, the flange 64 may be provided with any number of protuberances 66, depending upon on the number of shiftable valve members 34 and flow apertures 30 provided. In addition, the protuberance 66 may be provided with a height H1 variable up to approximately equal to a width W of the recess 40. By varying the height H1 of the protuberance 66, the degree to which the shiftable valve member 34 will be open when the protuberance 66 is engaged with the recess 40 will also vary. The number and height H1 of the protuberances 66, as well as their respective locations along the flange 64, may be varied and provided in any number of combinations depending upon the number of shiftable valve members 34, and upon the degree to which it is desired to hold each valve member 34 open for a given position of the indexing sleeve 52. Various manners in which the indexing sleeve 52 may be remotely rotated within the body member 12 will now be explained.

As shown in FIGS. 1A–1B and 4, the indexing cylinder 52 includes an indexing profile 68 engaged with an operating piston 70 (FIG. 1B). In a specific embodiment, as shown in FIG. 4, the indexing profile 68 may include an alternating series of ramped slots 72 disposed in a zig-zag pattern about the indexing sleeve 52 and proximate a second end 63 thereof. In a specific embodiment, each slot 72 may include a first end 74, a second end 76, and a retaining shoulder 78. Each slot 72 inclines upwardly from its first end 74 to its second end 76. The first end 74 of any given slot 72 is disposed adjacent the second end 76 of its immediately neighboring slot 72. The intersection of each set of adjacent first and second ends 74 and 76 is defined by a corresponding retaining shoulder 78.

As best shown in FIG. 1B, the operating piston 70 may include an arm 80 having a finger 82 disposed at a distal end thereof and engaged with the indexing profile 68 in the indexing sleeve 52. The operating piston 70 may be sealably disposed for axial movement within a piston cylinder 84 formed in the body member 12. In a specific embodiment, the piston cylinder 84 may be formed between the outer and inner walls 18 and 20. In a specific embodiment, a first surface 86 of the operating piston 70 may be in fluid communication with a source of pressurized fluid (not shown), which may be supplied through a hydraulic conduit 88 (see FIG. 1A). In a specific embodiment, the hydraulic conduit 88 may be connected between the body member 12 and the earth's surface (not shown). As indicated by the dashed line 90 in FIG. 1A, the hydraulic conduit 88 is in fluid communication with a sealed chamber 92 in the body member 12 and with the first surface 86 of the operating piston 70 (see FIG. 1B).

With reference to FIG. 1B, this specific embodiment of this aspect of the present invention may further include some means of exerting force on a second surface 87 of the operating piston 70. In a specific embodiment, this force may be supplied by a spring 94. In another specific embodiment, this force may by supplied by annulus pressure through a port 96 through the outer wall 18 of the body member 12. In another specific embodiment, this force may be supplied by another source of pressurized fluid (not shown) through another hydraulic conduit (not shown) connected to the port 96. In another specific embodiment, the force may be supplied by pressurized gas, such as nitrogen, contained within a gas chamber 98 in the body member 12. In a specific embodiment, the pressurized gas may be contained within a gas conduit 100 coiled within an annular space 102 in the body member 12. In a specific embodiment, the port 96 may be a gas charging port, and may include a dill core valve (not shown), for charging the gas chamber 98 and/or gas conduit 100 with pressurized gas. The gas chamber 98 and/or gas conduit 100 may further include a lubricating barrier, such as silicone (not shown). The present invention is not intended to be limited to any particular means for biasing the operating piston 70 against the force of hydraulic fluid in the hydraulic conduit 88. These specific embodiments (i.e., spring, annulus pressure, another hydraulic control line, and gas charge) are merely provided as examples, and may be used alone or in any combination.

In operation, the piston finger 82 (see FIGS. 1B and 4) may be remotely moved within the indexing profile 68 in the indexing sleeve 52. If the force being applied to the first surface 86 of the operating piston 70 is greater than the force being applied to the second surface 87 of the operating piston 70, then the piston finger 82 will be biased downwardly against the first end 74 of one of the slots 72, as shown in FIG. 4. By the same token, if the force being applied to the first surface 86 of the operating piston 70 is less than the force being applied to the second surface 87 of the operating piston 70, then the piston finger 82 will be biased upwardly (not shown) against the first end 74 of one of the slots 72. To shift the piston finger 82 from the position shown in FIG. 4 into a different position, pressure is removed from the hydraulic conduit 88 until the force being applied to the second surface 87 of the operating piston 70 15 (FIG. 1B) (e.g., by the spring 94, gas charge, additional hydraulic control line, and/or annulus pressure) is sufficient to force the piston finger 82 upwardly along the inclined surface of the slot 72 until the piston finger 82 falls into the first end 74 of the immediately neighboring slot 72. If that pressure is maintained, the piston finger 82 will remain in this position. If the pressure in the hydraulic conduit 88 is increased above the upward force being applied to the second surface 87 of the operating piston 70, then the piston finger 82 will travel downwardly against the retaining shoulder 78 and along the upwardly inclined surface of the neighboring slot 72 into which it was just shifted. The retaining shoulder 78 will prevent the piston finger 82 from going back into the slot 72 from which it just came. The piston finger 82 will continue along the upwardly inclined surface until it falls into the next slot 72. By remotely moving the piston finger 82 within the indexing profile 68 in this manner, the indexing sleeve 52 is rotated into a plurality of discrete positions, thereby remotely controlling which of the shiftable valve members 34 are open and closed, depending on the number of protuberances 66 engaged with the recesses 40, and for those that are open, the extent to which they are opened. In this regard, movement of the piston finger 82 within the zig-zag indexing profile 68 will result in a separate discrete position of the indexing sleeve 52 for each position of the piston finger 82 in each of the first ends 74 of the slots 72. The number of discrete positions of the indexing sleeve 52 may be varied by varying the zig-zag profile 68, and may be designed to correspond to the number of shiftable valve members 34.

The flow control apparatus 10 of the present invention may further be provided with a mechanism for locking the at least one shiftable valve member 34 in a fully-closed, or sealing, position. In this regard, with reference to FIGS. 1A and 4, the apparatus 10 may further include a lockdown sleeve 104 engaged with the indexing sleeve 52 and with at least one lockdown piston 106. In a specific embodiment, the lockdown sleeve 104 may be disposed about the indexing sleeve 52, and, as best shown in FIG. 4, may include at least one locking finger 108 engaged with a corresponding at least one locking slot 110 in the indexing sleeve 52. The engagement of the locking fingers 108 with the locking slots 110 prohibits relative rotational movement between the indexing sleeve 52 and the lockdown sleeve 104, but permits relative longitudinal movement between the two only when the indexing sleeve 52 and the lockdown sleeve 104 are in a particular discrete rotational position. Specifically, longitudinal relative movement between the indexing sleeve 52 and the lockdown sleeve 104 will be permitted when a locking protuberance 112 extending from a first end 114 of the lockdown sleeve 104 is aligned with a locking recess 116 disposed in a locking shoulder 118 extending from the outer wall 18 of the body member 12. The locking shoulder may include a first surface 128 and a second surface 129. In a specific embodiment, the locking recess 116 may be disposed in the second surface 129 of the locking shoulder 118. This aspect of the present invention will be more fully described momentarily.

With reference to FIG. 1A, the at least one lockdown piston 106 may include a first end 107 connected to an annular locking member 119, as by threads. In a specific embodiment, the annular locking member 119 may be disposed between the outer and inner walls 18 and 20, and between the second ends 42 of the shiftable valve members 34 and the first surface 128 of the locking shoulder 118. The lockdown piston 106 may further include an arm 120 having a finger 122 disposed at a second end 109 of the lockdown piston 106 and engaged with an annular groove 124 in the lockdown sleeve 104. In a specific embodiment, as shown in FIG. 1A, the at least one lockdown piston 106 may be sealably disposed for axial movement within a lockdown cylinder 126 in the body member 12, and be in fluid communication with pressurized fluid in the hydraulic conduit 88. In a specific embodiment, the lockdown cylinder 126 may be disposed in the locking shoulder 118. In a specific embodiment, the diameter of the lockdown piston cylinder 126 may be less than the diameter of the operating piston cylinder 84 (FIG. 1B).

In operation, when pressurized fluid is being supplied from the hydraulic conduit 88 to the sealed chamber 92, the pressurized fluid will apply an upward force to the at least one lockdown piston 106 and a downward force to the operating piston 70. The upward force applied to the at least one lockdown piston 106 is translated to the lockdown sleeve 104 through the lockdown finger 122 on the lockdown piston 106 and the annular groove 124 in the lockdown sleeve 104. As best shown in FIG. 4, so long as the locking protuberance 112 on the first end 114 of the lockdown sleeve 104 is not aligned with the locking recess 116 in the body member 12, the first end 114 of the lockdown sleeve 104 and the second surface 129 of the lockdown shoulder 118 will be separated by a gap G, and no upward force will be applied through the annular locking member 119 to the at least one shiftable valve member 34. When the locking protuberance 112 is rotated into alignment with the locking recess 116, however, the at least one lockdown piston 106 will shift upwardly, carrying the locking protuberance 112 into engagement with the locking recess 116 and forcing the annular locking member 119 against the second end 42 of the at least one shiftable valve member 34 to lock the at least one shiftable valve member 34 into its closed, or sealing, position. To unlock the at least one shiftable valve member 34, the indexing sleeve 52 is rotated into its next discrete position, in the manner explained above, thereby disengaging the locking protuberance 112 from the locking recess 116. It is noted that the locking recess 116 may include a ramped surface 117 to facilitate the disengagement of the locking protuberance 112 therefrom.

With reference to FIG. 4, it is noted that the cam-like protuberance 66 on the flange 64 at the first end 62 of the indexing sleeve 52 are preferably not engaged with any of the recesses 40 of the shiftable valve members 34 when the locking protuberance 112 on the first end 114 of the lockdown sleeve 104 is aligned with the locking recess 116 in the body member 12. It is further noted that the at least one locking finger 108 on the lockdown sleeve 104 has a height H2 larger than the gap G so that the at least one locking finger 108 will not become disengaged from the at least one locking slot 110 in the indexing sleeve 52 when the locking protuberance 112 shifts into engagement with the locking recess 116.

Figure 5:
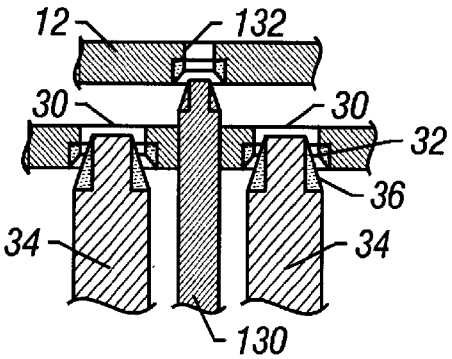
FIG. 5 is a radial cross-sectional view taken along line 5—5 of FIG. 2.
Figure 6:
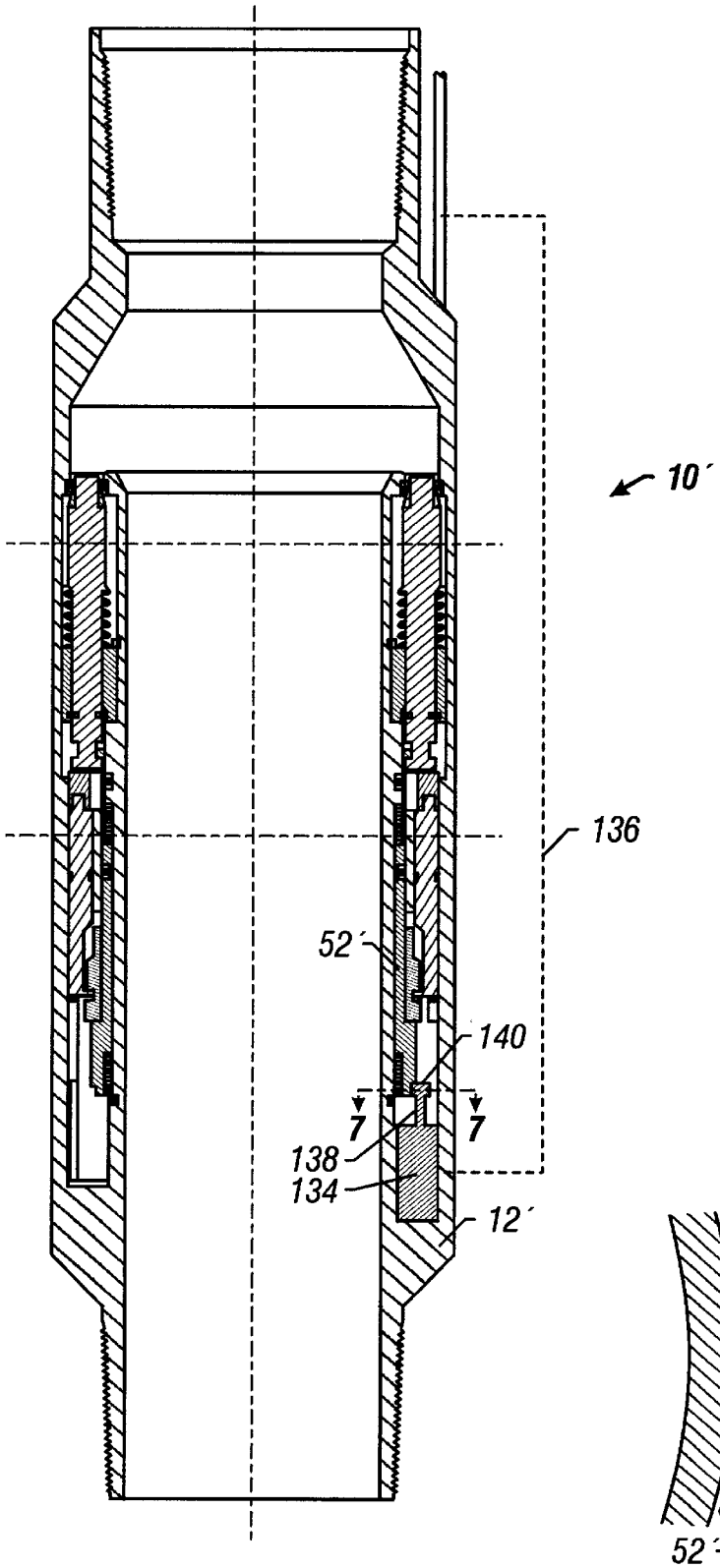
FIG. 6 is a longitudinal cross-sectional view of an electrically-actuated embodiment of the apparatus of the present invention.

Referring now to FIG. 5, it can be seen that, in addition to the shiftable valve members 34, the flow control apparatus 10 of the present invention may further include at least one secondary shiftable valve member 130 for controlling fluid flow through a secondary flow aperture 132 in the body member 12. The secondary valve member 130 and secondary flow aperture 132 may include annular sealing surfaces as described above in relation to the valve member 34 and flow aperture 30. The structure and operation of the secondary valve member 130 is substantially the same as described above with regard to the valve member 34. In a specific embodiment, the diameters of the secondary valve member 130 and the secondary flow aperture 132 may be smaller than the respective diameters of the shiftable valve member 34 and flow aperture 30. In a specific embodiment, the secondary flow apertures 132 may be disposed in a portion of the body member 12 nearer the first end 14 of the body member 12 than the flow apertures 30.

Figure 7:
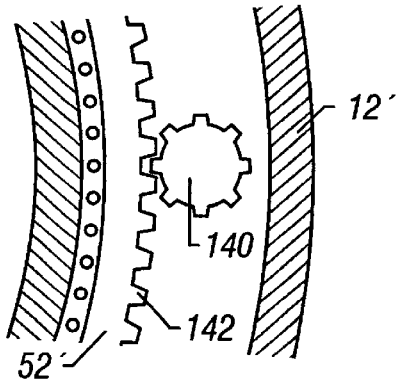
FIG. 7 is a partial cross-sectional view taken along line 7—7 of FIG. 6.

Another manner by which the indexing sleeve 52 may be remotely rotated will now be described with reference to FIGS. 7 and 8. In this specific embodiment, an electric motor 134 is secured to the body member 12' and connected to an electrical conduit 136 running from the earth's surface (not shown). The electric motor 134 is mechanically engaged with the indexing sleeve 52'. The electric motor 134 may include a shaft 138 having a pinion gear 140 connected thereto. As shown in FIG. 7, the pinion gear 140 may be engaged with a plurality of teeth 142 disposed about the indexing sleeve 52'. When electrical energy is supplied to the motor 134, the pinion gear 140 will be rotated, which will cause the indexing sleeve 52' to rotate. Operation of the apparatus 10' is as described above in all other respects.

Figure 8:
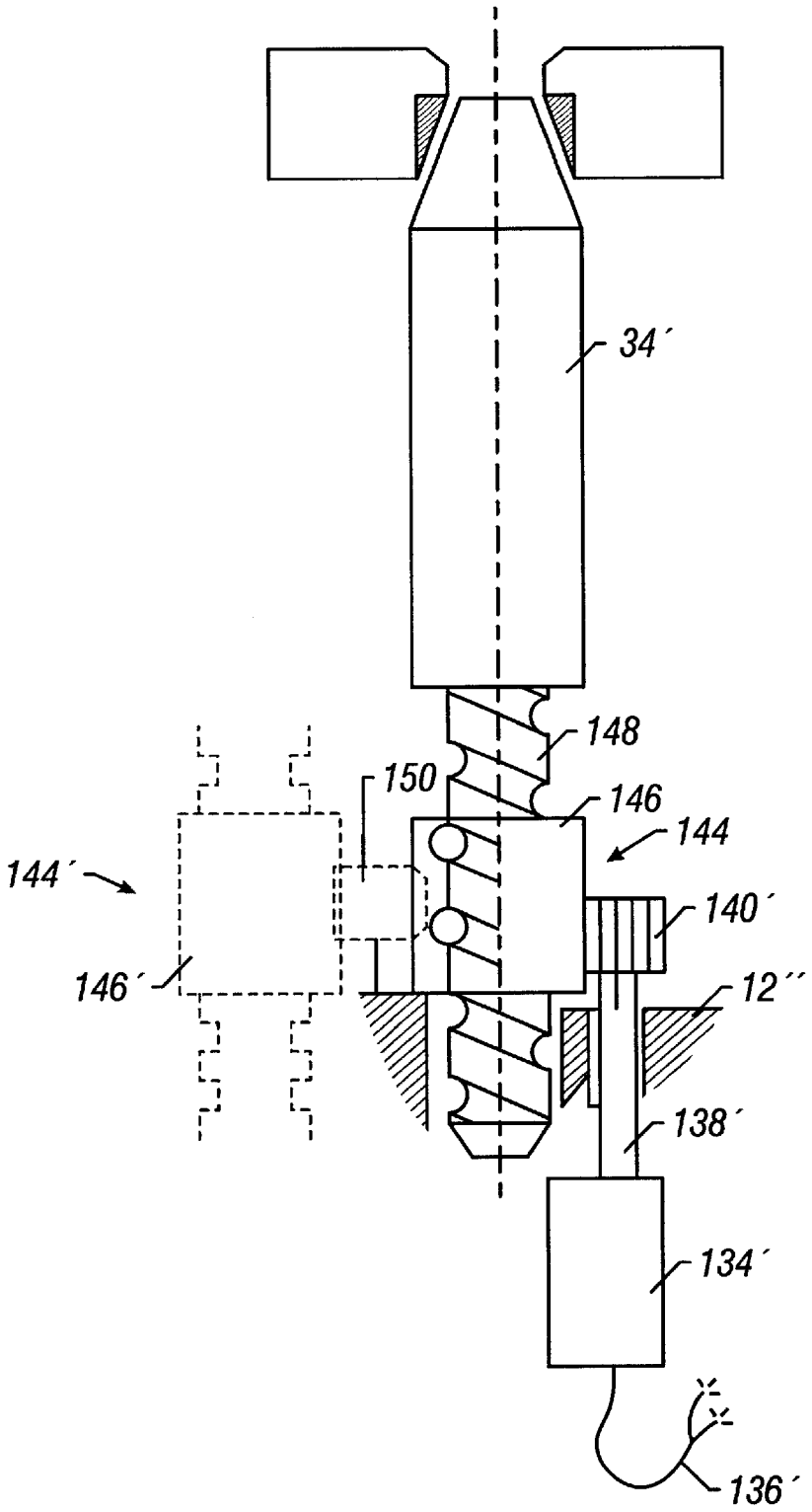
FIG. 8 is a longitudinal cross-sectional view of another electrically-actuated embodiment of the apparatus of the present invention.

Another electrically-operated embodiment of the present invention is shown in FIG. 8. In this specific embodiment, the indexing sleeve 52 is omitted, and an electric motor 134' is engaged with one of the at least one shiftable valve members 34'. A ball and screw assembly 144 may be connected between the electric motor 134' and the valve member 34'. The electric motor 134' may be connected to the body member 12" and to an electrical conductor 136' in the same manner as described above. The electric motor 134' may also include a shaft 138' having a pinion gear 140' connected thereto, in the same manner as described above. The pinion gear 140' may be engaged with the ball 146, which is threadably engaged with the screw 148. The screw 148 may be connected to or part of the valve member 34'. By energizing the motor 134', the pinion 140' will be rotated, which will rotate the ball 146. Rotation of the ball 146 results in longitudinal movement of the screw 148 and valve member 34'. The direction of longitudinal movement depends on the direction of rotation of the pinion 140'. Additional valve members may be controlled by the motor 134' by disposing an idler gear 150 between the ball 146 and another ball 146' of another ball and screw assembly 144', to which another valve member may be connected. Any number of additional valve members may be controlled by the motor 134' in this manner.

The flow control apparatus 10 of the present invention may be used to remotely control the production of hydrocarbons from a producing formation or to inject fluids (e.g., injection chemicals) from the earth's surface into a well and/or producing formation. If used to produce hydrocarbons from a formation, the apparatus 10 is preferably connected to a production tubing (not shown) with the first end 14 of the body member 12 nearer the earth's surface than the second end 16 of the body member 12. If, on the other hand, the apparatus 10 is used to inject chemicals from the earth's surface, then it is preferably connected to a production tubing (not shown) with the second end 16 of the body member 12 nearer the earth's surface than the first end 14 of the body member 12.

While the foregoing is directed to the preferred embodiment of the present invention, other and further embodiments of the invention may be devised without departing from the basic scope thereof, and the scope thereof is determined by the claims which follow. It is the express intention of the applicant not to invoke 35 U.S.C. § 112, paragraph 6 for any limitations of any of the claims herein, except when the claim expressly uses the words "means for" together.

We claim:

1. An apparatus for remote control of wellbore fluid flow, comprising:

a body member having at least one flow port in an outer wall of the body member, and at least one flow aperture spaced from the outer wall, the at least one flow aperture having a first annular sealing surface;

at least one remotely shiftable valve member offset from an inner bore in the body member and disposed for reciprocal movement within the body member to regulate fluid flow through the at least one flow aperture and through the at least one flow port, the at least one remotely shiftable valve member having a second annular sealing surface adapted for cooperative sealing engagement with the first annular sealing surface; and an actuator adapted to selectively shift the at least one remotely shiftable valve member between open and closed positions.

2. The flow control apparatus of claim 1, wherein the actuator includes an indexing sleeve rotatably disposed within the body member and engaged with the at least one shiftable valve member to shift the at least one shiftable valve member within the body member.

3. The flow control apparatus of claim 2, wherein the indexing sleeve is disposed for rotatable movement about an inner wall within the body member and secured to the inner wall to restrict longitudinal movement therebetween.

4. The flow control apparatus of claim 2, wherein a first end of the indexing sleeve includes a flange movably engaged with a recess in a second end of the at least one shiftable valve member, the flange including at least one protuberance engageable with the recess.

5. The flow control apparatus of claim 2, wherein the indexing sleeve is rotatable into a plurality of discrete positions to remotely control the degree to which the at least one shiftable valve member is opened and closed.

6. The flow control apparatus of claim 2, wherein the actuator further includes an operating piston engaged with the indexing sleeve and movably disposed within the body member in response to pressurized fluid.

7. The flow control apparatus of claim 6, wherein the indexing sleeve includes an indexing profile having an alternating series of ramped slots disposed in a zig-zag pattern about the indexing sleeve, and the operating piston includes an arm having a finger disposed at a distal end thereof and engaged with the indexing profile.

8. The flow control apparatus of claim 7, wherein each ramped slot includes a first end and a second end, each ramped slot inclining upwardly from its first end to its second end, the first and second ends of neighboring slots being disposed adjacent one another, and an intersection of each of the adjacent first and second ends being defined by a retaining shoulder.

9. The flow control apparatus of claim 6, wherein the operating piston is sealably disposed for movement within an operating piston cylinder in the body member between the inner and outer walls.

10. The flow control apparatus of claim 6, wherein a first side of the operating piston is in fluid communication with a source of pressurized fluid, and a second side of the operating piston is biased in opposition to the source of pressurized fluid by at least one of a spring, a contained source of pressurized gas within the body, and a remote source of pressure.

11. The flow control apparatus of claim 6, further including a lockdown sleeve engaged with the indexing sleeve and with at least one lockdown piston, a first end of the lockdown sleeve having a locking protuberance releasably engageable with a locking recess in the body member, a first end of the at least one lockdown piston being connected to an annular locking member, the at least one lockdown piston causing the annular locking member to force the at least one shiftable valve member into a locked position when the locking protuberance is engaged with the locking recess.

12. The flow control apparatus of claim 11, wherein the at least one lockdown piston includes an arm having a finger disposed at a second end of the lockdown piston and engaged with an annular groove in the lockdown sleeve, is in fluid communication with a source of pressurized fluid, has a diameter less than a diameter of the operating piston, and is sealably disposed for movement within a lockdown piston cylinder in the body member.

13. The flow control apparatus of claim 2, wherein the actuator further includes an electrical conduit connected to an electric motor, the electric motor being secured to the body member and mechanically engaged with the indexing sleeve.

14. The flow control apparatus of claim 13, wherein the electric motor includes a shaft having a pinion gear connected thereto, the pinion gear adapted for engagement with a plurality of teeth disposed about the indexing sleeve.

15. The flow control apparatus of claim 1, wherein the actuator includes an electrical conduit connected to an electric motor, the electric motor being secured to the body member and mechanically engaged with the at least one remotely shiftable valve member.

16. The flow control apparatus of claim 13, wherein the electric motor includes a shaft having a pinion gear connected thereto, the pinion gear being adapted for engagement with a ball and screw assembly, the ball being rotatably engaged with the pinion gear, and the screw being connected to the at least one shiftable valve member and threadably disposed within the ball.

17. The flow control apparatus of claim 1, wherein the body member further includes a first end, a second end, and an inner wall disposed within the body member, spaced from the outer wall, extending from the second end of the body member, and having a distal end terminating within the body member, the at least one flow aperture and the at least one shiftable valve member being disposed between the inner and outer walls.

18. The flow control apparatus of claim 1, further including a spring biasing the at least one shiftable valve member toward the at least one flow aperture.

19. The flow control apparatus of claim 1, wherein the at least one remotely shiftable valve member is sealably disposed for movement within a valve cylinder in the body member.

20. The flow control apparatus of claim 1, further including at least one secondary shiftable valve member for controlling fluid flow through a corresponding secondary flow aperture in the body member, diameters of the at least one secondary shiftable valve member and the secondary flow aperture being less than respective diameters of the at least one shiftable valve member and the flow aperture.

21. An apparatus for remote control of wellbore fluid flow, comprising:

a body member having a first end, a second end, an outer wall, an inner wall, at least one flow port in the outer wall, and at least one flow aperture disposed between the inner and outer walls, the inner wall being spaced from the outer wall, extending from the second end of the body member, and having a distal end terminating within the body member;

at least one remotely shiftable valve member disposed for reciprocal movement within the body member between the inner and outer walls to regulate fluid flow through the at least one flow aperture and through the at least one flow port;

an indexing sleeve disposed for rotatable movement about the inner wall and secured to the inner wall to restrict longitudinal movement therebetween, and engaged with the at least one shiftable valve member to shift the at least one shiftable valve member within the body member; and an operating piston engaged with the indexing sleeve, sealably disposed for movement within an operating piston cylinder in the body member between the inner and outer walls, a first side of the operating piston being in fluid communication with a source of pressurized fluid, and a second side of the operating piston being biased in opposition to the source of pressurized fluid by at least one of a spring, a contained source of pressurized gas within the body member, and a remote source of pressure.

22. The flow control apparatus of claim 21, wherein a first end of the indexing sleeve includes a flange movably engaged with a recess in a second end of the at least one shiftable valve member, the flange including at least one protuberance engageable with the recess.

23. The flow control apparatus of claim 21, wherein the indexing sleeve includes an indexing profile having an alternating series of ramped slots disposed in a zig-zag pattern about the indexing sleeve, and the operating piston includes an arm having a finger disposed at a distal end thereof and engaged with the indexing profile.

24. The flow control apparatus of claim 23, wherein each ramped slot includes a first end and a second end, each ramped slot inclining upwardly from its first end to its second end, the first and second ends of neighboring slots being disposed adjacent one another, and an intersection of each of the adjacent first and second ends being defined by a retaining shoulder.

25. The flow control apparatus of claim 21, further including a lockdown sleeve engaged with the indexing sleeve and with at least one lockdown piston, a first end of the lockdown sleeve having a locking protuberance releasably engageable with a locking recess in the body member, a first end of the at least one lockdown piston being connected to an annular locking member, the at least one lockdown piston causing the annular locking member to force the at least one shiftable valve member into a locked position when the locking protuberance is engaged with the locking recess.

26. The flow control apparatus of claim 21, wherein the indexing sleeve is rotatable into a plurality of discrete positions to remotely control the degree to which the at least one shiftable valve member is opened and closed.

27. An apparatus for remote control of wellbore fluid flow, comprising:

a body member having at least one flow port in an outer wall of the body member, and at least one flow aperture spaced from the outer wall, the at least one flow aperture having a first annular sealing surface;

shiftable valve means for regulating fluid flow through the at least one flow aperture including at least one remotely shiftable valve member having a second annular sealing surface adapted for cooperative sealing engagement with the first annular sealing surface; and actuating means for selectively shifting the valve means between open and closed positions.

28. The flow control apparatus of claim 27, wherein the actuating means includes:

rotatable indexing means engaged with the valve means for shifting the valve means;

piston means engaged with the indexing means for shifting the indexing means into a plurality of discrete positions; and means for remotely controlling movement of the piston means.

29. The flow control apparatus of claim 27, wherein the actuating means includes electrically-operated means connected to the body member and engaged with the valve means.

30. An apparatus for remote control of wellbore fluid flow, comprising:

a body member having at least one flow port in an outer wall of the body member, and at least one flow aperture spaced from the outer wall;

least one remotely shiftable valve member offset from an inner bore in the body member and disposed for reciprocal movement within the body member to regulate fluid flow through the at least one flow aperture and through the at least one flow port, the at least one remotely shiftable valve member having a first end and a second end; and an actuator adapted to selectively shift the at least one remotely shiftable valve member between open and closed positions, wherein one of the first and second ends of the at least one remotely shiftable valve member is at least partially within the at least one flow aperture when in the closed position.

31. An apparatus for remote control of wellbore fluid flow, comprising:

a body member having at least one flow port in an outer wall of the body member, and at least one flow aperture spaced from the outer wall;

at least one remotely shiftable valve member offset from an inner bore in the body member and disposed for reciprocal movement within the body member to regulate fluid flow through the at least one flow aperture and through the at least one flow port, said reciprocal movement being along a longitudinal axis of said remotely shiftable valve member; and the at least one flow aperture being at least partially axially aligned with the longitudinal axis of the at least one remotely shiftable valve member; and an actuator adapted to selectively shift the at least one remotely shiftable valve member between open and closed positions.

* * * * *